US005731665A

United States Patent [19]

Pruett

[11] Patent Number: 5,731,665

[45] Date of Patent: Mar. 24, 1998

[54] POWER REGULATOR FOR FLUORESCENT LAMP

[75] Inventor: Henry Frazier Pruett, St. Paris, Ohio

[73] Assignee: Grimes Aerospace Company, Urbana, Ohio

[21] Appl. No.: 607,600

[22] Filed: Feb. 27, 1996

Related U.S. Application Data

[63] Continuation of Ser. No. 286,773, Aug. 5, 1994, abandoned.

[51] Int. Cl.[6] ..... H05B 37/02

[52] U.S. Cl. ..... 315/247; 315/324; 315/307

[58] Field of Search ..... 315/291, 307, 315/308, DIG. 5, DIG. 7, 208, 224, 247

[56] References Cited

U.S. PATENT DOCUMENTS

| | | | |
|---|---|---|---|
| 5,034,663 | 7/1991 | Cook et al. | 315/308 |
| 5,103,143 | 4/1992 | Daub | 315/308 |
| 5,204,587 | 4/1993 | Mortimer et al. | 315/308 |
| 5,212,428 | 5/1993 | Sasaki et al. | 315/308 |

*Primary Examiner*—Robert Pascal
*Assistant Examiner*—David Vu
*Attorney, Agent, or Firm*—Standley & Gilcrest

[57] ABSTRACT

A circuit arrangement controls power to a fluorescent lamp rather than controlling current. Since light output is proportional to power, flicker control is improved and lamp life is extended.

1 Claim, 3 Drawing Sheets

POWER REGULATOR FOR FLUORESCENT LAMP

This application is a file wrapper continuation of application Ser. No. 08/286,773 filed Aug. 5, 1994 now abandoned.

BACKGROUND AND SUMMARY OF THE INVENTION

The present invention related generally to a control circuit for a fluorescent ballast, and more particularly to a circuit arrangement which controls the power in a fluorescent lamp.

Fluorescent lamps have been known to flicker during operation. The flicker can be noticeable to the human eye which can be distracting. Ballast structures are well-known with fluorescent lamps to provide power by controlling the lamp current.

Ballast for use in aircraft fluorescent lamps are subject to conditions which are more demanding than the condition that fluorescent lamps are usually subjected to when in use in homes, offices, ect. The life of the lamps is important in any use, but especially so for use in aircraft.

It has been known that one of the chief causes of flicker in a fluorescent lamp is the variations in input voltage to the ballast (or ballast system). These variations not only can cause distractions to the human eye but can shorten the life of the lamp. The present invention provides an improved electronic ballast especially adapted for aircraft use having an improved power controller. The present invention provides a power controller which maintains constant power to the lamp. Constant power to the lamp will reduce or even eliminate flicker, and will increase the life of the lamp.

From the following detailed description, it will be apparent that the ballast of the present invention offers several previously unknown advantages. Different variations of the circuit arrangements described herein to acheive constant power to a lamp will be apparent to one of ordinary skill in the art and would fall within the scope of the following claims.

DETAILED DESCRIPTION OF A PREFERRED EMBODIMENT(S)

Figure 1:
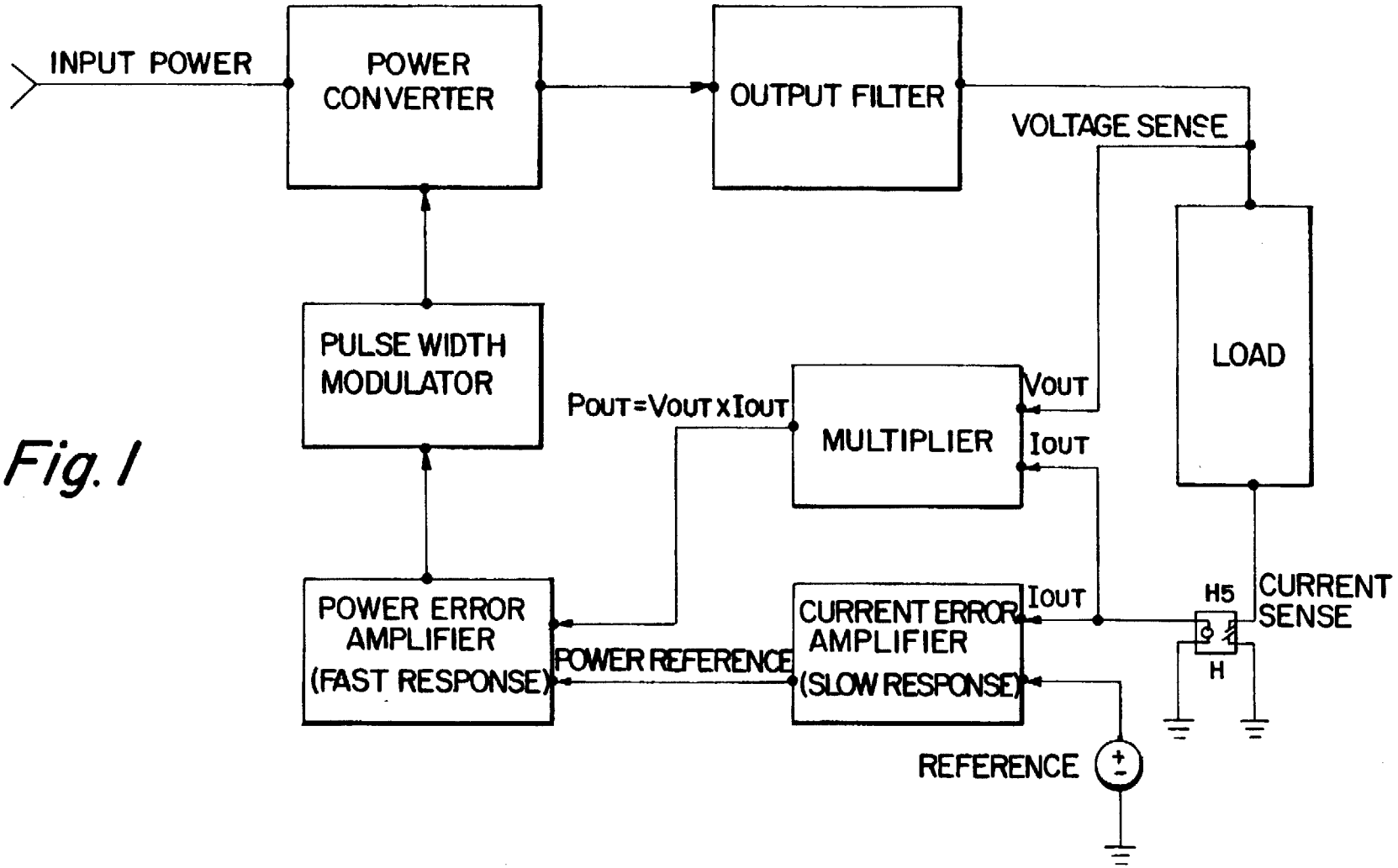
FIG. 1 is a block diagram of the ballast system of the present invention.

Referring now to the drawings, there is illustrated in FIG. 1 a block diagram of the ballast system of the present invention which provides constant power to one or more fluorescent lamps. In FIG. 2, a preferred embodiment of the circuit arrangement of the constant power control is shown.

The circuit of the present invention preferably includes three identified portions. The first is the multiplier circuit which produces a signal at its output that is the time average product of the current at the sense pin and the output voltage. This signal is the analog of the power in the load (the lamp).

The second identified portion of the circuit shown in FIG. 2, is the current error amplifier loop which detects the size of the lamp and regulates the reference voltage to the power control loop. The power control loop, the third portion of the circuit, which also acts as a power error amplifier loop, compares the output from the current error amplifier loop and the multiplier, and adjusts the output to a pulse width modulator in such a way to make the difference between its two inputs equal to 0. When this occurs, the power to the lamp is regulated and maintained as a constant throughout the operational time of the lamp which prevent flicker and increases the life of the lamp.

Figure 2A:
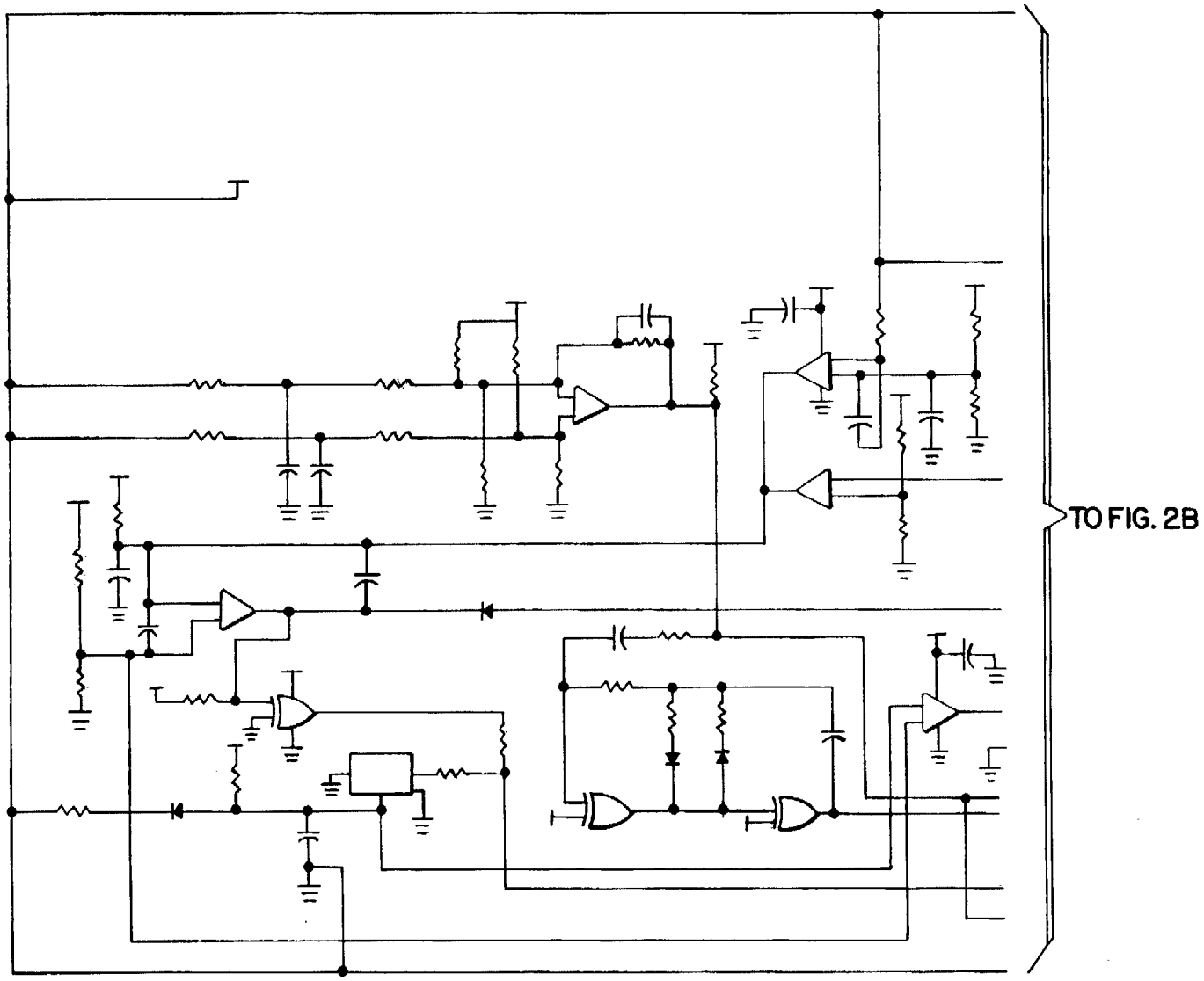
FIG. 2A is a preferred embodiment of a constant power control circuit diagram of the present invention.
Figure 2B:
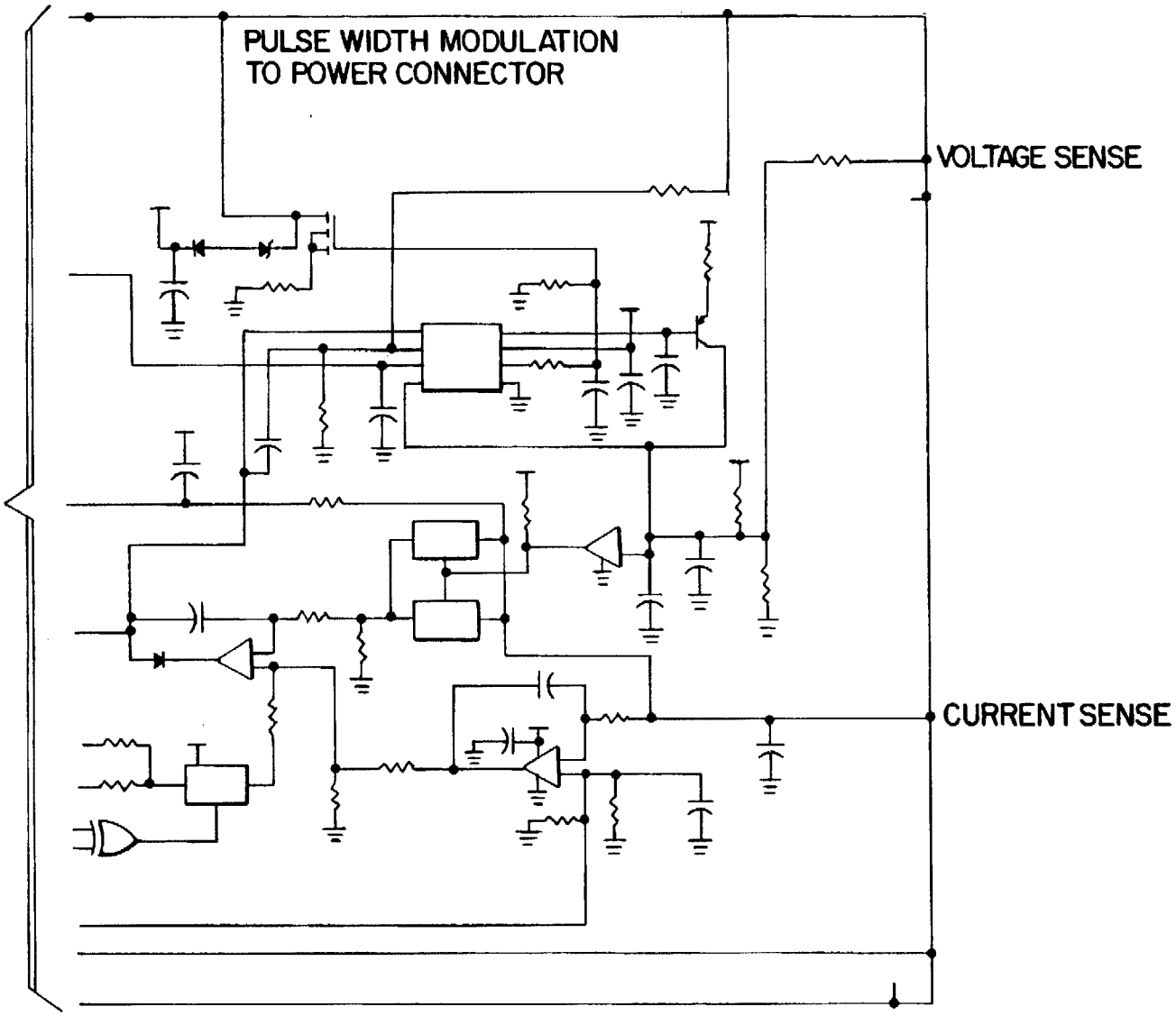
FIG. 2B is a continuation of FIG. 2A along lines A—A.

A preferred embodiment of the present invention is shown in FIGS. 2A and 2B. In the preferred embodiment a multiplier circuit comprises a comparator along with other circuit elements to provide a voltage output that represents the power flowing through the load. In simple mathematic terms, the multiplier simply multiplies the voltage drop sensed across the load by the current flowing through the load. Simultaneously, a current error amplifier senses the current flowing through the load and compares it to a reference. A power error amplifier, which may comprise another comparator, receives the voltage signal from the multiplier representing the power through the load and the voltage signal from the current error amplifier. The power error amplifier produces a voltage that represents the degree of error in power being supplied to the load. As an example, if the power flowing through the load is close to correct the power error amplifier provides a small voltage output. If the power flowing throught the load is far from the desired power the power error amplifier may provide a large voltage signal at its output. The pulse width modulator receives the output signal from the power error amplifier and provides a pulsed signal to a power converter. In a preferred embodiment, the larger the voltage signal received from the power error amplifier the longer the duration of the pulsed signals supplied to the power converter, and vice-versa. The present invention thereby provides a novel feedback mechanism for controlling the power supplied to a load.

What is claimed is:

1. A constant power control system for a fluorescent ballast comprising:

a multiplier having an output signal which is the time average product of the voltage sensed from a lamp and the current in said lamp;

a current error amplifier electrically connected to said lamp and a reference, wherein said current error amplifier senses the current in said lamp, compares the current in said lamp with the current in said reference, and produces an output signal;

a power error amplifier directly electrically connected to said output of said current error amplifier, said power error amplifier further having a second input from said multiplier output, said power error amplifier providing an output signal by comparing said output from said current error amplifier and said multiplier; and a pulse width modulator electrically connected to said output of said power error amplifier, wherein said pulse width modulator provides a pulsed signal to a power converter which maintains the power to the lamp as a constant throughout the operational time of the lamp eliminating flicker during operation and increasing the life of the lamp.

* * * * *

UNITED STATES PATENT AND TRADEMARK OFFICE

CERTIFICATE OF CORRECTION

PATENT NO. : 5,731,665

DATED : March 24, 1998

INVENTOR(S) : Henry F. Pruett

It is certified that error appears in the above-identified patent and that said Letters Patent is hereby corrected as shown below:

Column 1, line 11, delete the word "related" and insert – relates --.
Column 1, line 19, delete the word "Ballast" and insert – Ballasts --.
Column 2, line 9, delete the word "prevent" and insert – prevents --.

Signed and Sealed this

Fourteenth Day of July, 1998

Bruce Lehman

*Attest:*

BRUCE LEHMAN

*Attesting Officer*

*Commissioner of Patents and Trademarks*